United States Patent [19]

Theurer

[11] Patent Number: 4,572,079

[45] Date of Patent: Feb. 25, 1986

[54] MOBILE TRACK LEVELING, LINING AND TAMPING MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 643,865

[22] Filed: Aug. 24, 1984

[30] Foreign Application Priority Data

Oct. 27, 1983 [AT] Austria ..... 3819/83

[51] Int. Cl.[4] ..... E01B 27/17

[52] U.S. Cl. ..... 104/7 B; 104/12

[58] Field of Search ..... 104/2, 7 R, 7 A, 7 B, 104/8, 12; 105/26 R, 62 R, 133

[56] References Cited

U.S. PATENT DOCUMENTS 3,968,752 7/1976 Theurer ..... 104/7 B 4,186,665 2/1980 De Jong et al. ..... 105/26 R X

FOREIGN PATENT DOCUMENTS 2069573 8/1981 United Kingdom .

*Primary Examiner*—Randolph A. Reese

*Attorney, Agent, or Firm*—Kurt Kelman

[57] ABSTRACT

A mobile track leveling, lining and tamping machine has an elongated machine frame carrying a power plant and operating controls, and an operator's cab arranged on the machine frame at front end and a rear end thereof at a first level and including a control for the machine drive in each one of the operator's cabs. A tamping tool unit is mounted for vertical adjustment with respect to the elongated machine frame and a track leveling and lining unit precedes the tamping tool unit in the operating direction. A third operator's cab precedes the units and is arranged within sight of the units at a lower level between the operator's cabs at the machine frame ends, the third cab including controls for the tamping, leveling and lining tools. A connecting path leads within the elongated machine frame from the third cab to the operator's cab at the front end, the connecting path providing the sole access to the third cab, and an entry to the connecting path provides access thereto from outside the track.

6 Claims, 2 Drawing Figures

MOBILE TRACK LEVELING, LINING AND TAMPING MACHINE

The present invention relates to improvements in a mobile track leveling, lining and tamping machine comprising an elongated machine frame carrying a power plant and operating control means, undercarriages supporting respective ends of the machine frame on the track for movement in an operating direction, and a drive for moving the machine frame along the track. An operator's cab is arranged on the machine frame at a front end and a rear end thereof at a first level, the operating control means including a control for the drive in each one of the operator's cabs. A tamping tool unit is mounted between the undercarriages for vertical adjustment with respect to the elongated machine frame, the tamping tool unit including power-driven pairs of reciprocable and vibratory tamping tools. A track leveling and lining unit precedes the tamping tool unit in the operating direction, the leveling and lining unit including power-driven track leveling and lining tools, and the operating control means including leveling and lining reference systems controlling the track leveling and lining tools. A third operator's cab precedes the units in the operating direction and is arranged within sight of the units at a level lower than the first level and between the operator's cabs at the machine frame ends, the third cab including control means for the tamping, leveling and lining tools.

A machine of this type has been disclosed in U.S. Pat. No. 3,968,752, dated July 13, 1976, which has tamping, leveling and lining tools designed for operation in track switches. The third operators' cab has a floor at a level just above the track plane and provides an excellent visual observation point for monitoring the operation of the tamping, leveling and lining tools. Such a third cab for operating the working units of the machine and which is accessible from outside the track has been used with great success, and most modern track switch tampers have such operating control cabs as standard equipment. Usually, the operator's cabs at the front and rear ends of the machine frame have their separate entries, the front cab being equipped with means for receiving characteristic data inscribed on the track, such as the superelevation, the radius of a curve and the like, while the rear cab is equipped with instruments for indicating and recording paramaters characterizing the track position, i.e. level and/or line. The additional cost for three operator's cabs is more than compensated by the higher operating quality and increased driving safety achieved by this construction.

Figure 2:
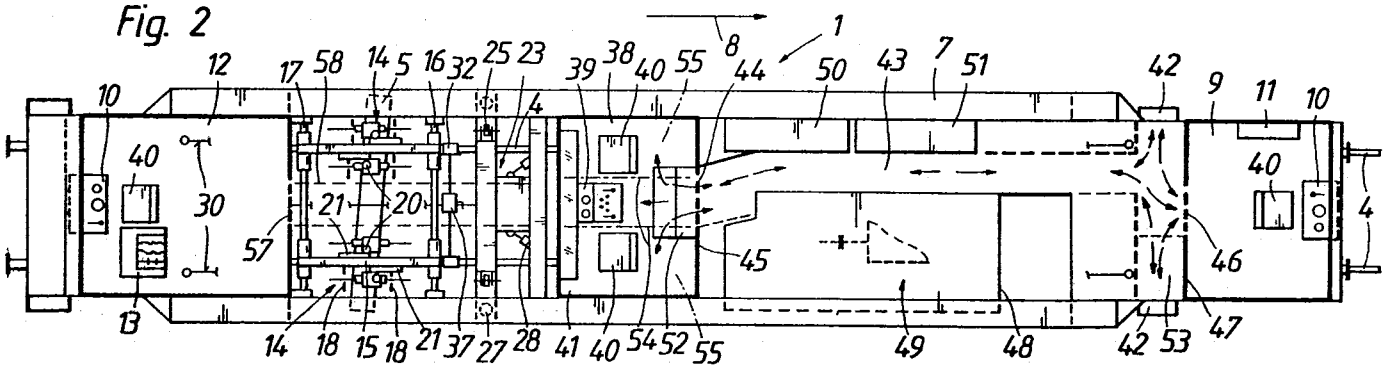

U.K. patent application No. 2,069,573 A, published Aug. 26, 1981, discloses a machine of this general type in FIG. 2, wherein two like operators' cabs are arranged at the same level on a front platform of the machine frame, the two cabs being connected by a roofed compartment carrying the power plant. According to the embodiment of FIG. 4 of this published patent application, the compartment is open on both sides and an entry is provided to the open sides of the compartment for access to the cabs through the compartment. Both cabs are equipped with controls for the machine drive. In addition, setting and indicating elements for the desired lining values are arranged in the front cab while the rear cab houses controls for the tamping, leveling and lining tools. Since the two operators' cabs are mounted on a platform above the front swivel truck of the machine at a relatively high level above the track plane, it is quite difficult for the operator in the rear cab to have a good view of the operating tools, particularly the more remotely and much lower disposed tamping tools. Therefore, a visual observation of the immersion of the tamping tool jaws in three successive cribs is not possible with this arrangement. Furthermore, the track section behind the machine cannot be properly viewed since the machine frame is upwardly recessed to accommodate the tamping tool unit and this upwardly extending machine frame portion blocks the view, which is disadvantageous when the machine is moved from one operating site to another in a direction opposite to that of the operating direction.

It is the primary object of this invention to provide a mobile track leveling, lining and tamping machine of the first-described type which offers more favorable and safer working conditions to the operating personnel, thus fully meeting the ever more demanding requirements of the railroads.

The above and other objects are accomplished according to the invention in a surprisingly simple manner by equipping such a machine with a connecting path leading within the elongated machine frame from the third cab to the operator's cab at the front end, the connecting path providing the sole access to the third cab, and an entry to the connecting path providing access thereto from outside the track.

This arrangement provides substantial operational and safety advantages, assuring particularly a much more rapid and absolutely safe transition between pure drive and operation of the machine. Thus, it is possible to move an operator into the third cab while the machine is still driven to the operating site without interrupting the movement of the machine to the site and without walking on the track. This operator, who during the advancement of the machine to the operating site stays in the front cab which is much roomier and more comfortable than the third cab and who may help the engineer who drives the machine in observing the track, may move through the connecting path to the third cab in complete safety and may ready the operating controls before arrival at the operating site so as to be in a position to start work without delay as soon as the machine has arrived at the site. In this manner, the third cab may be manned without walking on the track, which is often forbidden by safety regulations, and no safety measures need be taken to monitor the track and warn against oncoming traffic.

A third operator's cab of the indicated type, which is closed off to the outside of the track and is accessible solely by the connecting path within the machine frame has additional advantages. The absence of door openings in the side walls of the third cab provides a light, yet rigid enclosed structure which may be readily air-conditioned. Furthermore, the enclosing side walls are available for housing indicating and control instruments.

Figure 1:
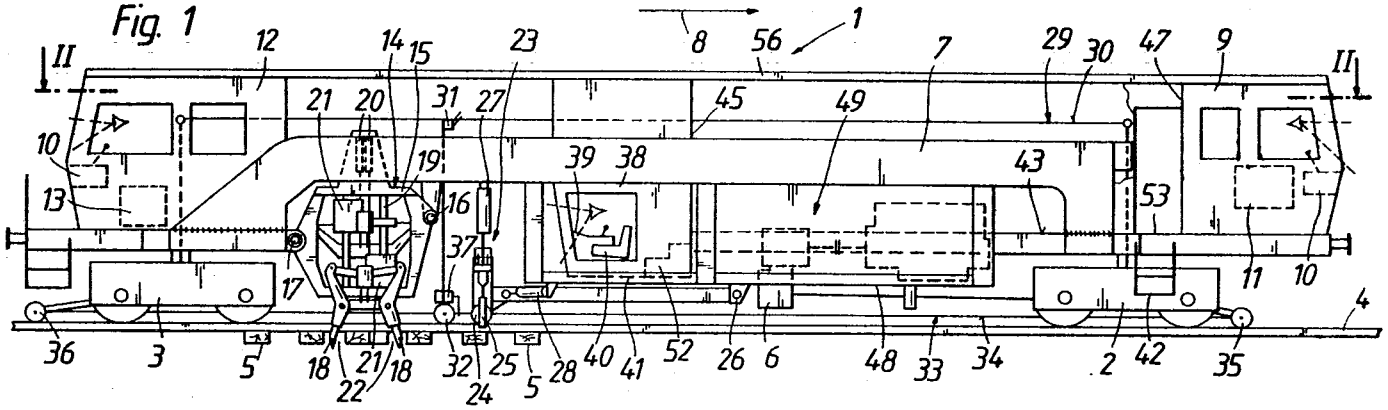

The above and other objects, advantages and features of the present invention will become more apparent from the following detailed description of a now preferred embodiment, taken in conjunction with the accompanying somewhat schematic drawing wherein FIG. 1 shows a side elevational view of a track leveling, lining and tamping machine according to this invention; and FIG. 2 illustrates a simplified top view of the machine along line II—II of FIG. 1.

Referring now to the drawing, there is shown mobile track leveling, lining and tamping machine 1 comprising elongated machine frame 7 carrying power plant and operating control means 49 in housing 48. Undercarriages illustrated as swivel trucks 2, 3 support respective ends of the machine frame on a track consisting of rails 4 fastened to ties 5 for movement in an operating direction indicated by arrow 8. Drive 6 is connected to the power plant and operating control means to transmit power to the wheels of front undercarriage 2 for moving the machine frame in the operating direction along the track. Operator's cab 9 is arranged on machine frame 7 at a front end thereof, as seen in the operating direction, and operator's cab 12 is arranged at a rear end of the machine frame, cabs 9 and 12 being arranged at a first level. The operating control means include a control at control panel 10 in each cab. Front operator's cab 9 further comprises means 11 for receiving or setting characteristic data inscribed on the track, such as the superelevation, radius of the curve and the like while instruments 13 for indicating and recording parameters characterizing the track position are mounted in rear operator's cab 12.

A respective tamping tool unit 14 associated with a respective rail 4 is mounted between swivel trucks 2, 3 for vertical adjustment with respect to elongated machine frame 7 and includes two power-driven pairs of reciprocable and vibratory tamping tools 18 arranged for immersion at the gage and field sides of each rail. The illustrated tamping unit is arranged for operation in track switches and comprises frame 15 transversely displaceable along horizontal guide columns 16, 17 by suitable drives, the guide columns extending transversely to the track. Each tamping tool carrier frame 21 is independently vertically movably mounted on tamping tool unit frame 15, being guided by vertical support column 19 and linked to vertical adjustment drive 20. This arrangement enables the tamping tools to be selectively and individually displaced so that selected pairs of tamping tools may be immersed in the ballast to the left or to the right of a selected rail for tamping, depending on the specific track configuration. FIG. 2 illustrates merely by way of example a track configuration where ballast is to be tamped under obliquely positioned tie 5 and it is assumed that there is an obstacle to the immersion of the tamping tools at the gage side of right rail 4, as seen in the operating direction. Therefore, as shown on the left in tamping tool unit 14 in FIG. 1, one of the tamping tool carriers 21 remains in its upper positions while the other tamping tool carriers are lowered to immerse their tamping tools in the ballast in cribs 22 adjacent to oblique tie 5, as indicated in FIG. 2.

Track leveling and lining unit 23 precedes tamping tool unit 14 in the operating direction. Unit 23 includes power-driven track leveling and lining tools constituted in the illustrated embodiment by flanged lining rollers 24 and lifting hooks 25 which are selectively engageable with the base of head of the rail. The track leveling and lining unit is universally linked to machine frame 7 by universal joint 26, on the one hand, and lifting drives 27 and lining drives 28, on the other hand, which are linked to the machine frame. The operating control means include leveling and lining reference systems 29 and 33 controlling the track leveling and lining tools. The leveling reference system comprises reference wires 30 associated with rails 4 and having ends supported on swivel trucks 2, 3, track level sensing elements 31 cooperating with the reference wires to generate a control signal operating lifting drives 27 for leveling the track. The track level sensing elements are supported on bogie 32 running on the track rails between tamping tool units 14 and track leveling and lining unit 23. Lining reference system 33 is illustrated schematically and essentially comprises lining reference wire 34 extending centrally between rails 4 from front track sensing element 35 to rear track sensing element 36 and cooperating with sensing element 37 associated with bogie 32 and monitoring the track ordinates. Sensing element 37 generates a control signal operating lining drives 28.

Third operator's cab 38 precedes units 14 and 23 in the operating direction and is arranged between cabs 9 and 12 within sight of the units at a level lower than the first level at which cabs 9 and 12 are arranged. Cab 38 includes control means 39 for the tamping, leveling and lining tools and holds two seats 40 for operators. Cab 38 is enclosed on all sides by large glass walls and floor 41 of the cab is at a level considerably lower than that of the floors of cabs 9 and 12 so as to provide optimum conditions for the visual observation of the track section being worked by tamping tools 18 and leveling and lining tools 24, 25. A machine of the hereinabove described type has been disclosed in U.S. Pat. No. 3,968,752 but the present invention is not limited to any specific tool arrangements, except for their relative positions with respect to the operator's cabs.

In accordance with this invention, connecting path 43 leads within elongated machine frame 7 from third cab 38 to operator's cab 9 at the front end and this connecting path provides the sole access to third cab 38. Entry 42 at each side of the machine frame provides access to connecting path 43 from outside the track. In the illustrated embodiment, operator's cab 9 and third cab 38 have facing walls 47, 45, door 44 in wall 45 and door 46 in wall 47 opening outwards and connecting path 43 leading to doors 44 and 36, the doors providing the sole access to the cabs. Entries 42 are arranged immediately rearwardly of operator's cab 9 at the front end and provide a common access for both cabs. This provides a particularly simple construction giving immediate access to front cab 9 from outside the track and at a safe distance from the operating tools. This eliminates any danger of injuries to the operating personnel by the operating tools as the operators enter or leave the machine.

In the illustrated embodiment, housing 48 for power plant and operating control means 49 is arranged laterally adjacent connecting path 43 and the connecting path is disposed at the first level, i.e. the level of cabs 9 and 12, and passes the power plant at the left. As clearly shown in FIG. 2, hydraulic fluid tank 50 and fuel tank 51 are arranged to the left of connecting path 43. Steps 52 lead from the first level of connecting path 43 to the lower level of floor 41 of third cab 38. This lay-out enables the connecting path of the invention to be readily retrofitted in widely used machines of this general type. The arrangement of the connecting path laterally adjacent the power plant, which usually is of considerable height, makes it possible to reduce the difference between the level of the connecting path and that of the floor of the third cab to a minimum while arranging this floor as closely to the track plane as possible to maximize the visual observation of the operations. By suitably arranging and distributing the power plant and operating control means components, for example the lateral displacement or oblique positioning of the main drive motor of the machine, which usually requires the largest amount of space, connecting path 43 may extend at the same level as front cab 9, thus avoiding steps leading from the connecting path to the front cab and making the passage therebetween more comfortable. The ready access of personnel to cabs 9 and 38 and movement therebetween has been indicated in FIG. 2 by small arrows showing how operators entering at 42 may move freely to and between cabs 9 and 38, as well as from one side of the track to the other by entering by an entry 42 on one side of the track and leaving by the entry on the other side, all of these personnel movements proceeding off the track and in full safety within the machine frame.

FIG. 2 illustrates in dash-dotted lines a modification comprising, instead of an operators' cab 38 extending over the entire width of the machine frame, respective operator's cab 55 associated with each rail of the track and centered above a respective track rail. Third cabs 55 have entry doors, for example slide doors, providing sole access thereto and connecting path 43 has an extension leading to these doors. This modification is of particular advantage in heavy high-production tampers used in switch track maintenance work since the two cabs respectively associated with the rails provide particularly good visual observation of the tools associated with each rail, such tools often operating under different conditions at each rail and, therefore, requiring very close monitoring.

To protect the power plant and operating control means as well as the personnel from adverse weather conditions, roof 56 on elongated machine frame 7 covers the entire connecting path. In the illustrated embodiment, the roof also extends over connecting path 58 (shown in broken lines in FIG. 2) to rear cab 12, connecting path 58 leading to slide door 57 in a wall of cab 12 to provide access from cab 12 to units 14 and 23 so that maintenance and repair personnel may be able to reach the operating tools without entering the track.

What is claimed is:

1. A mobile track leveling, lining and tamping machine comprising (a) an elongated machine frame carrying a power plant and operating control means, (b) undercarriages supporting respective ends of the machine frame on the track for movement in an operating direction, (c) a drive for moving the machine frame along the track, (d) an operator's cab arranged on the machine frame at a front end and a rear end thereof at a first level, (1) the operating control means including a control for the drive in each one of the operator's cabs, (e) a tamping tool unit mounted between the undercarriages for vertical adjustment with respect to the elongated machine frame, the tamping tool unit including (1) power-driven pairs of reciprocable and vibratory tamping tools, (f) a track leveling and lining unit preceding the tamping tool unit in the operating direction, the leveling and lining unit including (1) power-driven track leveling and lining tools, (2) the operating control means including leveling and lining reference systems controlling the track leveling and lining tools, (g) a third operator's cab preceding the units in the operating direction and arranged within sight of the units at a level lower than the first level and between the operator's cabs at the machine frame ends, the third cab including (1) control means for the tamping, leveling and lining tools, (h) a connecting path leading within the elongated machine frame from the third cab to the operator's cab at the front end, said connecting path providing the sole access to the third cab, and (i) an entry to said connecting path providing access thereto from outside the track.

2. The mobile track leveling, lining and tamping machine of claim 1, further comprising means in the operator's cab at the front end of the elongated machine frame for receiving characteristic data inscribed on the track, and instruments in the operator's cab at the rear end of the machine frame for indicating and recording parameters characterizing the track position.

3. The mobile track leveling, lining and tamping machine of claim 1, wherein the power plant is arranged laterally adjacent the connecting path, the connecting path being disposed at said first level and passing by the power plant, and further comprising steps leading down from the connecting path to the lower level of the third cab.

4. The mobile track leveling, lining and tamping machine of claim 1, wherein the operator's cab at the front end and the third cab have facing walls, and further comprising respective doors in said facing walls, the connecting path leading to said doors and the doors providing the sole access to the cabs, the entry being arranged immediately rearwardly of the operator's cab at the front end and providing a common access for both cabs.

5. The mobile track leveling, lining and tamping machine of claim 1, wherein a respective one of said third operator's cabs is associated with each rail of the track, the respective third cab being centered above a respective one of the track rails, the third cabs having entry doors providing the sole access thereto and the connecting path leading to said doors.

6. The mobile track leveling, lining and tamping machine of claim 1, further comprising a roof on the elongated machine frame, the roof covering the entire connecting path.

* * * * *